United States Patent [19]

Rickling

[11] Patent Number: 4,548,392

[45] Date of Patent: Oct. 22, 1985

[54] PORTABLE GUN HOLDER CASE

[76] Inventor: Arthur R. Rickling, 5521 Mossvale Cir., Huntington Beach, Calif. 92649

[21] Appl. No.: 494,784

[22] Filed: May 16, 1983

[51] Int. Cl.[4] ..... B23Q 3/18

[52] U.S. Cl. ..... 269/156; 269/258; 269/275; 269/296; 269/901; 269/909

[58] Field of Search ..... 269/901, 296, 45, 71, 269/156, 258, 275, 909; 144/285; 108/28; 248/461; 211/64; 206/317; 190/29

[56] References Cited

U.S. PATENT DOCUMENTS

| | | | |
|---|---|---|---|
| 410,414 | 9/1889 | Hall | 269/45 |
| 868,966 | 10/1907 | Chase | 269/45 |
| 2,422,773 | 6/1947 | Colwill | 269/156 |
| 2,610,761 | 9/1952 | Fleming | 144/285 |
| 2,740,530 | 4/1956 | Ponder | 206/317 |
| 2,774,563 | 12/1956 | Pribis | 206/317 |
| 2,877,689 | 3/1959 | Pribis | 206/317 |
| 3,123,353 | 3/1964 | Schulze et al. | 269/296 |
| 3,731,818 | 5/1973 | Young | 206/317 |
| 4,294,444 | 10/1981 | Horton | 269/156 |
| 4,438,913 | 3/1984 | Hylla | 269/296 |

*Primary Examiner*—Robert C. Watson
*Attorney, Agent, or Firm*—Lyon & Lyon

[57] ABSTRACT

A portable gun case holder comprised of a pair of gun supports mounted within a carrying case wherein one of the gun supports is equipped with a clamping assembly which holds the gun in place wherein the clamping assembly may be adjusted to accommodate the individual characteristics of a particular gun and furthermore where the gun supports may be folded within the carrying case to allow for easy transportation of the invention.

14 Claims, 10 Drawing Figures

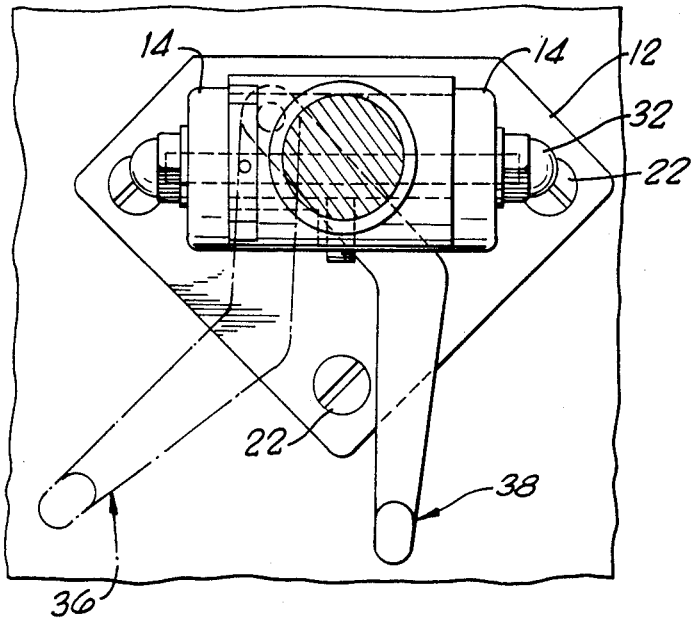
FIG. 4.
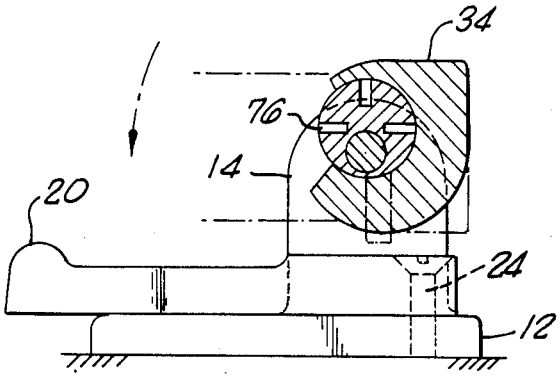
FIG. 6.
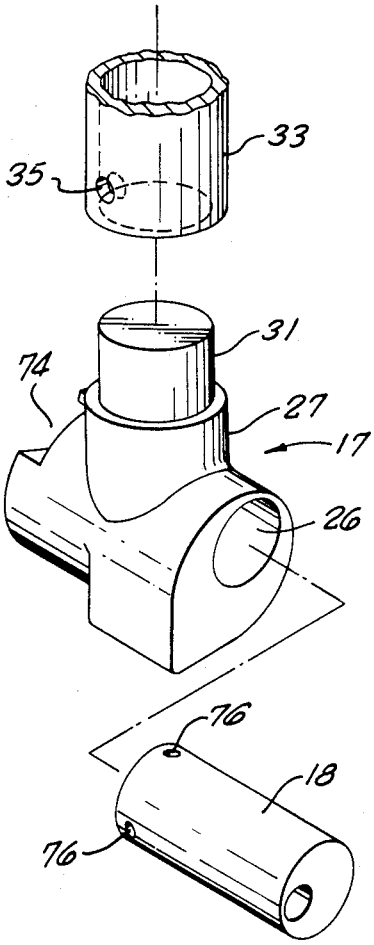
FIG. 7.
FIG. 5.
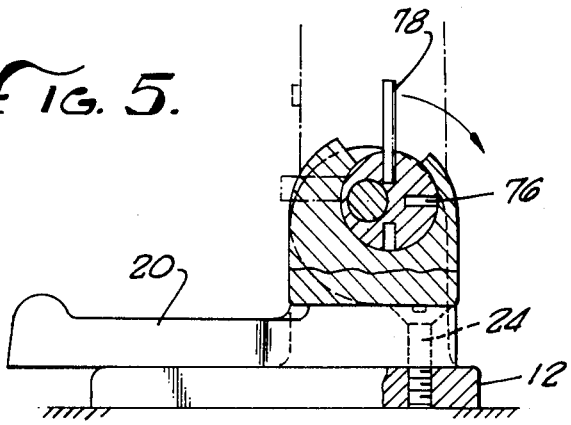

PORTABLE GUN HOLDER CASE

BACKGROUND OF THE INVENTION

This invention relates to gun vices or gun holders, more particularly to pre-assembled portable gun holders which may be easily transported and quickly and easily set-up for use and folded for storage and transportation.

To facilitate the proper cleaning and repair of a gun, a gun vice or gun holder is commonly used which holds the gun in a fixed position thereby allowing gunsmith or individual working on the gun free use of both hands to perform the desired tasks. Traditionally these gun vices or gun holders are rigidly mounted on a stationary support such as a workbench. There is a need, however, for a portable gun vice or gun holder which may be transported by the user to temporary, remote locations such as the open field, target ranges and other similar places away from a gunsmith or home workshop.

Prior devices in this field have required the assembly of a variety of components and the attachment of these components to some outside support such as a table or workbench. The need, therefore, exists for a portable, pre-assembled gun vice or gun holder which does not require the time consuming assembly of a variety of components which have previously been disassembled in order to provide for easy transportation of the gun holder. and also which do not require an outside support means. This invention satisfies the need for a portable, pre-assembled self-contained gun vice or gun holder.

There also exists a need for a portable gun holder which enhances the safety of the user. In the past gun owners in attempting to clean or repair their guns while in the field have generally held the gun in their lap or grasped it in one hand while working on the gun with their free hand. This practice has lead to numerous accidents. A need therefore exists for a safer means for cleaning or repairing a gun which provides the user with free use of both hands.

SUMMARY OF THE INVENTION

This invention comprises a gun holder mounted within and transported within a standard carrying case such as a briefcase or attache case. The gun holder is comprised of a front-end support member and a rear-end support and clamping member. During transportation, both the front-end support member and the rear-end support and clamping member are folded within the carrying case. When used in actual operation, the carrying case is opened and placed on a flat surface. The front-end support member and the rearend support and clamping member are then placed in locked, upright position and the gun holder is ready for use.

Thus, it is the object of this invention to provide a safe, simple, portable gun holder and carrying case.

It is another object of this invention to provide a portable gun holder which is completely pre-assembled within the carrying case.

It is still another object of this invention to provide a portable gun holder which does not utilize an outside support means.

These and other objects and advantages will be apparent from the following description in conjunction with the drawings.

BRIEF DESCRIPTION OF THE DRAWINGS

FIG. 4 is a partial top view of the rearend support base assembly.

FIG. 5 is a partial side view and cross-sectional view of the rear-end support base assembly when the rearend support and clamping member is in the upright position.

FIG. 6 is a side and partial cross-sectional view of the rear-end support base assembly when said assembly is in a down position.

FIG. 7 is a perspective exploded view of the front-end rotating pivot member and the adjustment cylinder.

DETAILED DESCRIPTION OF THE INVENTION

Figure 1:
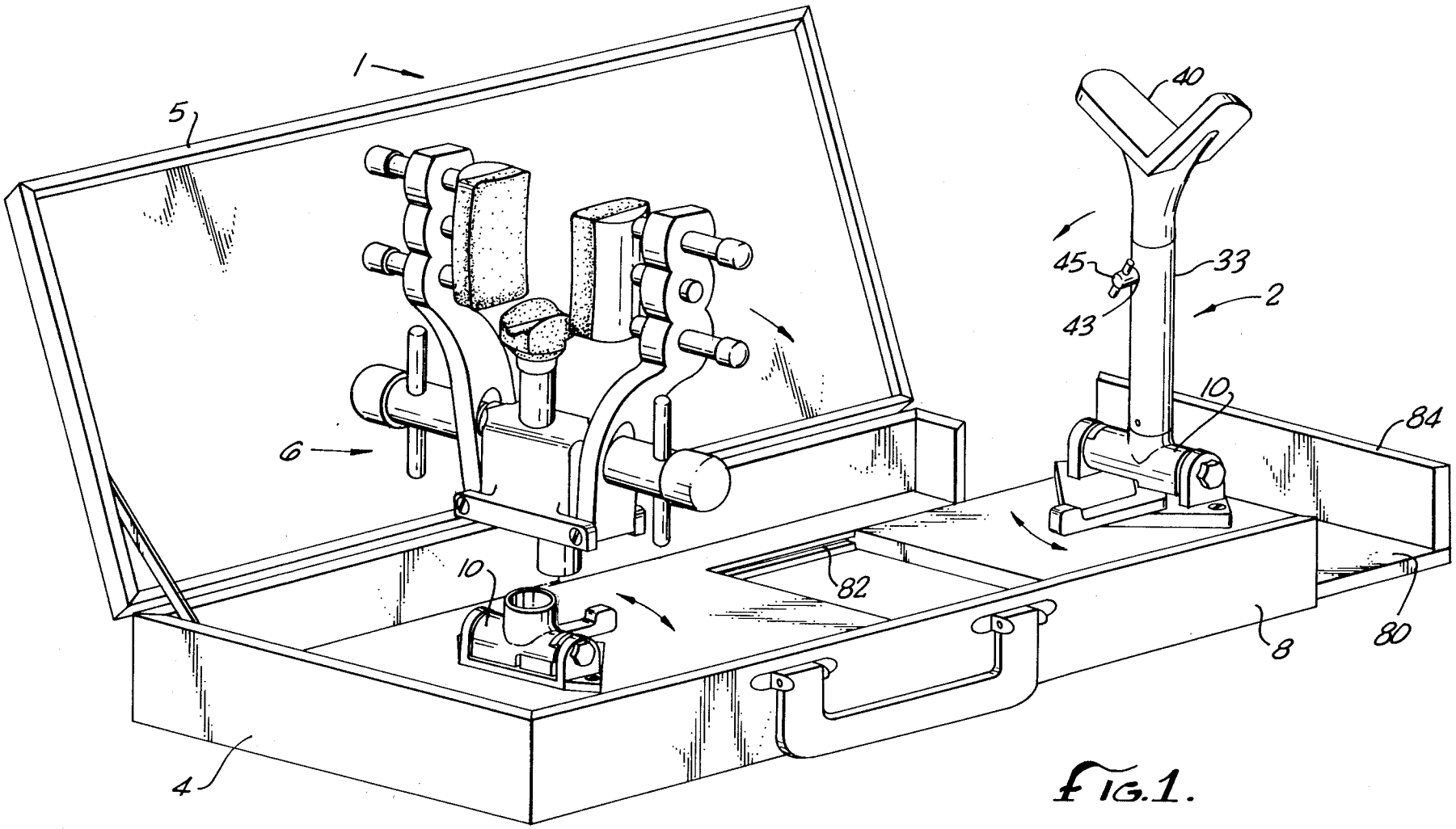
FIG. 1 is a perspective view of the invention set up in the operational mode.

The components of the gun holder 1 are shown set up in the operating mode in FIG. 1. A front-end support member 2 is mounted to the inside of the bottom of a carrying case 4. A rear-end support and clamping member 6 is mounted at the opposite end of the bottom of the carrying case 4. The front-end support member 2 and the rear-end support and clamping member 6 are mounted facing each other within the carrying case 4 such that the plane containing the center lines of the respective support members is parallel with the front face 8 of the carrying case 4.

In the preferred embodiment, both the front-end support member 2 and the rear-end support and clamping member 6 are attached to the carrying case 4 by means of a support base assembly 10. The support base assembly 10 is shown in FIGS. 3 thru 8. The support base assembly 10 is comprised of a base plate 12 having two vertical support arms 14; a pivot member 16; an adjustment cylinder 18; and a lockarm 20. The base plate 12 is fastened to the bottom of the carrying case 4 by means of mounting screws 22 as shown in FIG. 4. The lockarm 20 is attached to the base plate 12 adjacent to the inner face of one of the vertical support arms 14 by means of a pivot screw 24.

The two vertical support arms 14 are parallel to each other and are also parallel to the front face 8 of the carry case 4 when the base plate 12 is properly mounted in the carry case 4.

Figure 2:
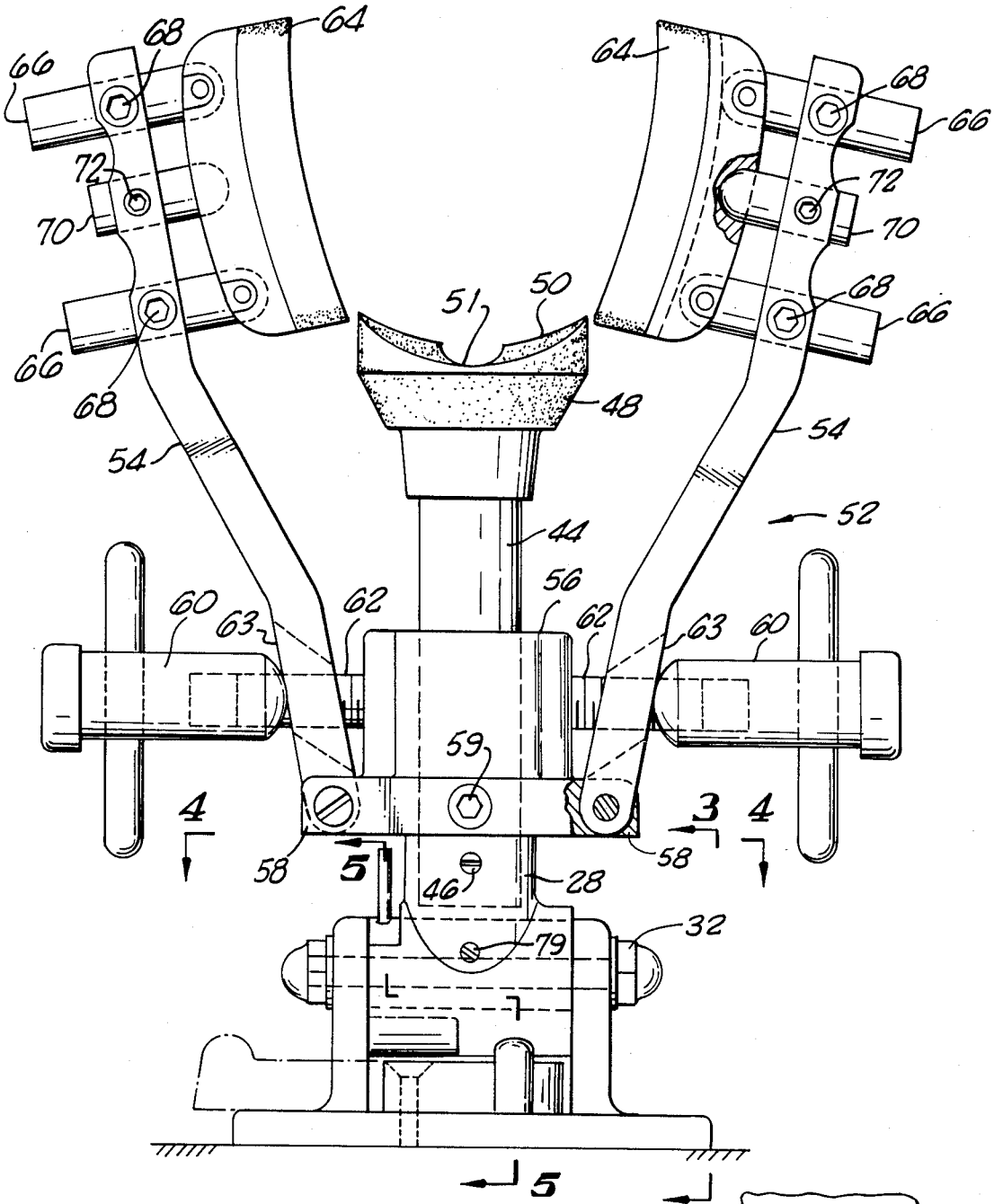
FIG. 2 is a front view of the rearend support and clamping member.
Figure 3:
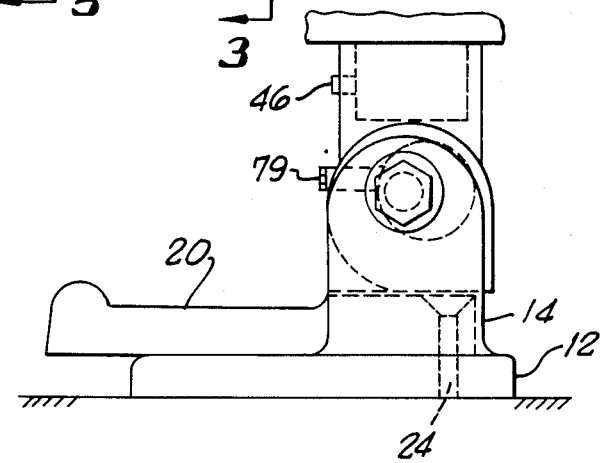
FIG. 3 is a partial side view of the rear-end support base assembly.
Figure 8:
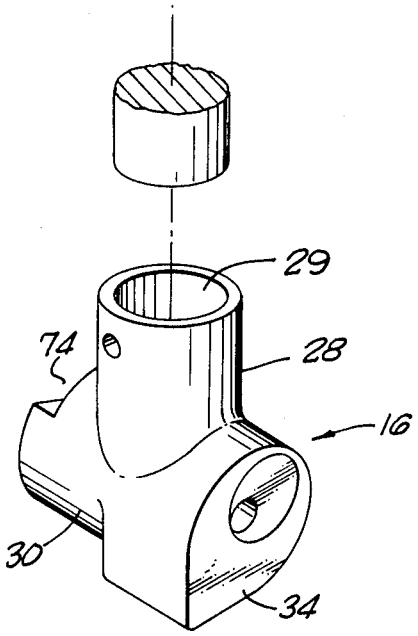
FIG. 8 is a perspective exploded view of the rear-end rotating pivot member.

The rear-end pivot member 16 is T-shaped in configuration as shown in FIG. 8. The pivot member 16 is comprised of a pivot body 30 which is joined with a support cylinder 28. The support cylinder 28 has a circular recess 29 in which the rear-end support and clamping member 6 is inserted. A cylindrical bore 26 transverses the length of the pivot body 30 as shown in FIGS. 7 and 8. The adjustment cylinder 18 fits tightly within the cylindrical bore 26. The combined pivot member 16 and adjustment cylinder 18 are mounted between the support arms 14 by means of a bolt 32 as shown in FIG. 4. As shown the support arms 14 are spaced a slightly greater distance apart than the length of the pivot body 30. The bolt 32 is inserted through a cylindrical passageway 33 in the adjustment cylinder 18, and passes through corresponding apertures in the support arms 14. The cylindrical passageway 33 is offset from the center axis of the adjustment cylinder 18 such that the passageway 33 is co-axial with the center axis of the pivot body 30 when the adjustment cylinder 18 is inserted within the pivot body 30. As shown in FIGS. 2 and and 7 the configuration of the pivot body 30 is such that the end of the pivot body 30, located above the pivot screw 24 is of a true cylindrical cross-section. The opposite end of the pivot body 30 has a support cam 34 which extends outward beyond the cylindrical configuration of the main body of the pivot body 30. When the lockarm 20 is moved to the storage position 36, the cylindrical portion of the pivot body 30 is aligned with the body of the lockarm 20 and the pivot body 30 may be rotated about bolt 32 from a vertical to a horizontal position. This horizontal placement is shown in FIG. 6. When it is desired to place the member in an upright position the pivot body 30 is rotated upward to a vertical position and the lockarm 20 is then rotated about the pivot screw 24 to point 38. When placed in this position, the lockarm 20 is located below the support cam 34. The support cam 34 rests on the upper surface of the lockarm 20 and prevents the forward or downward rotation of the pivot body 30. The above described support base assembly 10 is utilized in conjunction with the rear-end support and clamping member 6.

The front-end pivot member 17 is also T-shaped in configuration as shown in FIG. 7. The front-end pivot member 17 differs from the rear-end pivot member 16 in that the support cylinder 27 has a mounting peg 31 situated atop the support cylinder 27 as shown in FIG. 7. The mounting peg 31 is of a cylindrical configuration and is of a lesser diameter than the support cylinder 27. The front-end support member is attached to the front-end pivot member by means of a hollow cylindrical tube 33 which is inserted over the mounting peg 31 and held in place by means of a locking screw which passes through an aperture 35 in the wall of the tube 33 and engages the mounting peg 31. The front-end pivot member 17 is used in conjunction with the support base assembly 10 as described above.

When placed in use, the front-end support member 2 and the rear-end support and clamping member 6 are set in the vertical position. The front-end support member 2, as shown in FIG. 1, includes a V-support 40 which supports the front-end or barrel of a gun such as a rifle or shotgun. The V-support 40 is mounted atop a cylindrical shaft 42 which fits within the hollow cylindrical tube 33 and is held in place by a lock screw 45 which is inserted through a lock screw aperture 43 in the wall of the hollow cylindrical tube 33 and engages the cylindrical shaft 42 thereby locking it in place within the hollow cylindrical tube 33. The cylindrical shaft 42 may be moved upward or downward to the desired height. The height of the shaft 42 is locked in place by means of the lock screw 45 which passes through an aperture in the wall of the hollow cylindrical tube and engages the shaft 42.

Figure 9:
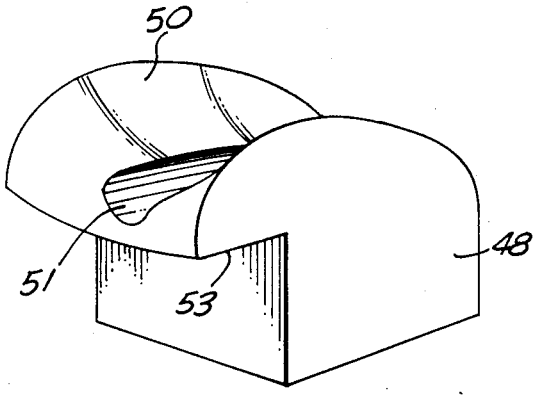
FIG. 9 is a perspective view of the rear-end support pad.
Figure 10:
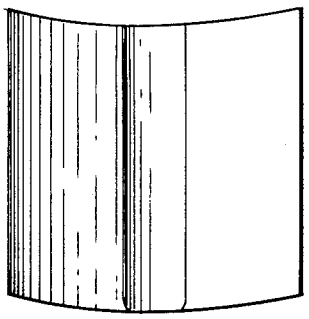
FIG. 10 is a top view of the rear-end support pad.

The rear-end support and clamping member 6 is shown in FIG. 2. A rear support shaft 44 fits within the support cylinder 28 and is held in place by a set screw 46. A support pad 48 is affixed to the top of the rear support shaft 44. In the preferred embodiment the support pad 48 is constructed out of rubber or any other suitable surface which will provide a non-slip resting service for the gun stock while at the same time not marring the finish of the gunstock. In the preferred embodiment as shown in FIGS. 9 and 10, the support pad 48 has a large hemispherical recess 50 running longitudinally along the top of the support pad. A small hemispherical recess 51 runs longitudinally along the center line of the large hemispherical recess 50. In actual use, the gun is placed in the rear-end support and clamping member and the stock of the gun rests on the support pad 48 and fits within the hemispherical recesses 50 and 51.

The support pad 48 also has a notch 53 cut in the front portion of the pad. The notch 53 grips the handle grip portion of the gun stock which customarily extends beyond the main body of the gun stock.

The gun is held in place by means of a clamping assembly 52 which is comprised of reciprocal clamping arms 54 which are attached to a central body member 56. The central body member 56 having a central passageway of the same configuration as the shaft 44. The shaft 44 passes through the passageway in the central body member 56 and is inserted into the support cylinder 28. The clamping assembly 52 can then be adjusted in height to varying positions along the shaft 44 and can be locked in place by means of a clamping screw 59 which is threaded through an aperture in the central member 56 and may be tightened down to engage the shaft 44 thereby locking the clamping assembly 52 at the desired height and position on the shaft 44. As shown in FIG. 2 the central body member 56 has four clamping flanges 58 which extend outward at right angles from the central body member 56, with two flanges on each side of the central body member 56. The clamping arm 54 fits between two of the clamping flanges 58 as shown in FIG. 1 and is held in place by a standard screw, the screw being inserted through corresponding apertures in the clamping flange 58, the clamping arm 54 and the second clamping flange 58, with the aperture in the second clamping flange being threaded.

The clamping arms may be adjusted horizontally to increase or decrease the space between the arms to accommodate gun stocks of varying sizes. The horizontal displacement of the clamping arm 54 is adjusted by means of adjustment handles 60. The clamping arms 54 each have a passageway 63 of circular or oval configuration which passes through the body of the clamping arm 54. The passageway 63 passes through the arm 54 at an angle as shown in FIG. 2 so as to create an articulated opening through the arm. This allows for the clamping arm 54 to be moved laterally along a clamping rod 62 which extends outward from the central body member 56, parallel to the clamping flanges 56 and passes through the clamping arms 54. The horizontal displacement of the clamping arms 54 is adjusted by tightening or loosening the handles 60 which are threaded onto the end of the clamping rod 62. As the handle is tightened down, the clamping arms 54 are pressed inward from opposite directions thereby applying opposing forces to the gun stock and locking the gun in place on the support pad 48.

The clamping force is actually transmitted to the stock of the gun by means of floating pads 64 which are attached to the clamping arms 54 by means of configuration adjustment rods 66 which pass through openings in the clamping arm 54. The configuration adjustment rods 66 allow for adjustment of the curvature of the floating pad 64 and are adjusted by means of set screws 68 which are threaded through apertures in the side wall of the clamping arm 54 and engage the configuration adjustment rods 66. To adjust the floating pad 64, one simply loosens the set screws 68 and adjusts or slides the configuration adjustment rods 66 in the desired direction and then tightens the lock screws 68 thereby locking the floating pad 64 in the desired position.

In the preferred embodiment, the horizontal displacement of the floating pad 64 may also be adjusted to increase or decrease the distance between of the pads. This adjustment is accomplished by means of a placement adjustment rod 70. One end of the placement rod fits within a recess in the back of the floating pad 64 and rests against the back of the pad, with the remaining end of the placement rod 70 passing through an aperture in the clamping arm 54. A placement set screw 72 is threaded through an aperture in the side wall of the clamping arm 54 and engages the side of the placement rod 66. To adjust the horizontal placement of the floating pad 64, one loosens the placement set screw 72 and simply pushes the placement rod inward towards the gun or pulls the rod outward from the gun to obtain the desired placement of the floating pad 64 against the gun stock. Once the floating pad has been placed in the desired configuration, the placement set screw 72 is tightened down thereby locking the pad in the desired horizontal position. It should be noted that the placement set lock screw 72 must be also loosened with the set screws 68 in order to allow for adjustment of the longitudinal displacement of the clamping pad 64, as described above.

In order to assure that the front-end support member 2 and the rear end support and clamping member 6 are rigidly locked when place in an upright position, the support base assembly 10 is equipped with an adjustment means. When the support leg is placed in an upright vertical position, the lock arm 20 is moved to position 38. In this position, the support cam 34 on the pivot cylinder 30 comes in contact with and rests upon the upper surface of the lock arm 20. To ensure that the support cam 34 rests firmly upon the upper surface of the lock arm 20 and does not allow for any minor movement or wobble in the support base assembly 10, the pivot cylinder 30 may be tightened down upon the lock arm 20 by means of the adjustment cylinder 18. The cylindrical end of the pivot cylinder 30 is equipped with a keyway section 74. This keyway section allows access to the cylindrical bore 26. The adjustment cylinder 18 is equipped with adjustment holes 76 which align with the keyway section 74 when the adjustment cylinder 18 is placed within the cylindrical bore 26. An adjustment pin 78 is inserted through the keyway 74 and into the adjustment holes 76. The pivot cylinder locking screw 79 is then loosened allowing the adjustment cylinder 18 to rotate. The pivot cylinder is then turned by means of pulling backward on the adjustment pin 78 until the support cam 34 comes into firm contact with the upper surface of the lock arm 20, thereby rigidly locking the support arm in the upright vertical position. At this time, the pivot adjustment cylinder locking screw 79 is tightened locking the support base assembly in place.

In order to accommodate guns with varying barrel lengths, in the preferred embodiment, the length of the carrying case 4 may be adjusted when the gun holder is in the operational mode. This adjustment feature is shown in FIG. 1. The floor 80 of the carrying case 4 fits within grooves 82 in the front wall and rear floor section of the carrying case. To expand the length of the gun holder one simply pulls outward on the front section of the sidewall 84 which is attached to the movable floor section 80. In the preferred embodiment, the movable floor section 80 may be adjusted to three different lengths. The floor section 80 is locked in place at one of the three positions by means of a standard band clip, the female ends of which are mounted within the grooves 82, with the male end being mounted on the exterior edge of the floor.

As shown in FIG. 1 when the gun is placed in the gun holder complete access is only available to the right side of the gun. Full access to the left side of the gun is obstructed by the carrying case lid 5. To obtain access to the left side of the gun, one simply unscrews the bolts 32 holding the pivot members in place and removes both the front-end support member 2 and the rear end support and clamping member 6 from their respective support base assemblies 10 and interchanges them with each other. In this new position the left side of the gun is fully exposed to the user.

In an alternate embodiment of the invention the carrying case is a collapsible, zipper case which when unzipped may be folded away from the gun mount allowing full access to both sides of the gun. This embodiment eliminates the need for interchanging the support members. In this embodiment the gun mounts are mounted on a flat floor section set in the bottom of the case, with the floor section being adjustable in length as described above.

Having thus described one embodiment of my invention in detail, it is to be understood that numerous equivalents and alterations which do not depart from the invention will be apparent to those skilled in the art, given the teaching herein. Thus, my invention is not to be limited to the above description, but is to be the full scope of the appended claims.

What is claimed is:

1. A portable gun holder comprising:

a carrying case;

a front-end suppordt member;

a rear-end support and clamping member said member including a pair of individually adjustable clamping arms; and two pivoting support base assemblies mounted within the carrying case wherein the front-end support member and the rear-end support and clamping member are each separately attached to one of the pivoting support base assemblies.

2. A portable gun holder as claimed in claim 1 wherein the front-end support member is comprised of a support pad affixed to the top of a shaft, with said shaft being inserted within a hollow cylindrical tube such that the support pad may be adjusted in height by means of raising or lowering the shaft within the tube and locked in place by means of a locking screw which is threaded through an aperture in the side wall of the tube and engages the shaft.

3. A portable gun holder as claimed in claim 1 wherein the rear-end support and clamping member is comprised of a support shaft which passes through a central body member having an aperture of the same configuration, and slightly greater cross-sectional area than the support shaft, two pair of support flanges extending outward in opposite directions from the central body member, a clamping arm pivotally attached to each pair of support arms, two tightening rods extending outward from opposite sides of the central body member and passing through articulated apertures in the clamping arms, the outside end of each tightening rod being threaded, two tightening handles which are threaded on the ends of the tightening rods and a clamping pad attached to the free end of each clamping arm.

4. A portable gun holder as claimed in claim 3 wherein the clamping pads are attached to the clamping arms by means of a plurality of configuration adjustment rods where one end of each of said rods is attached to the back of the clamping pad, the remaining end passing through a corresponding number of apertures in the clamping arm, said clamping arm being equipped with locking means for locking the adjustment rods in a fixed position.

5. A portable gun holder as claimed in claim 4 wherein the locking means is comprised of a plurality of set screws which pass through threaded apertures in the sidewall of the clamping arm and may be tightened down to engage the configuration adjustment rods.

6. A portable gun holder as claimed in claim 4 wherein the horizontal placement of the clamping pad may be altered by means of a clamping pad placement rod which fits within a recess in the back of the clamping pad; the other end of the placement rod passing through an aperture in the sidewall of the clamping pad, the placement rod being capable of being locked in place by means of a configuration set screw which passes through a threaded aperture in the side wall of the clamping arm and may be tightened down to engage the placement rod.

7. A portable gun holder as claimed in claim 1 wherein a portion of the floor of the carrying case rests within grooves in the front wall and rear floor section of the carrying case and may be pulled outward thereby lengthening the distance between the front-end support member and the rear-end support and clamping member.

8. A portable gun holder comprising:

a carrying case;

a front-end support member comprised of a support pad mounted atop a shaft inserted within a hollow tube which may be adjusted in height with respect to the hollow tube and is locked in place by means of a lock screw;

a rear-end support and clamping member comprised of a support shaft which passes through a central body member having an aperture of the same configuration and slightly greater cross-sectional area than the support shaft, two pairs of support flanges extending outward in opposite directions from the central body member, a clamping arm pivotally attached to each pair of support flanges, two tightening rods extending outward from opposite sides of the central body member and passing through articulated apertures in the clamping arms, the outside end of each tightening rod being threaded, two threaded tightening handles which are threaded on the ends of the tightening rods and a clamping pad attached to the free-end of each clamping arm; and two pivoting support base assemblies mounted within the carrying case wherein the front-end support member and the rear-end support and clamping member are each separately attached to one of the pivoting support base assemblies.

9. A portable gun holder as claimed in claim 8 wherein the support base assemblies are comprised of a mounting plate having parallel support arms extending upward from the mounting plate, a lockarm pivotally attached to the mounting plate adjacent to the inner surface of one of the support arms, a pivot member, and adjustment cylinder wherein the pivot member is comprised of a support cylinder connected to a pivot body, the front-end support member and rear-end support and clamping member each being attached to one of the support cylinders, the pivot cylinder being transversed by a cylindrical passageway, the adjustment cylinder being inserted within said passageway in the pivot cylinder and there being a cylindrical void passing through the adjustment cylinder, the pivot member and adjustment cylinder combination being pivotally mounted between the support arms.

10. A portable gun holder as claimed in claim 9 wherein the end of the pivot cylinder mounted above the lockarm is cylindrical in shape and has a keyway section cut in the top of the cylinder exposing the end of the adjustment cylinder; said end of the adjustment cylinder having a plurality of apertures spaced circumferencially about the adjustment cylinder and wherein the opposite end of the pivot member has a support cam extending outward from the cylindrical configuration such that when the lockarm is rotated about its pivot pin to a position beneath the support cam the support cam rests on the upper surface of the lockarm, and wherein the adjustment cylinder is locked in place by means of a set screw which is threaded through an aperture in the wall of the support cylinder and engages the adjustment cylinder.

11. A portable gun holder as claimed in claim 10 wherein the support cam may be firmly positioned against the lockarm by means of inserting an adjustment pin in one of the apertures in the adjustment cylinder, loosening the set screw and pulling backwards on the adjustment pin thereby causing the support cam to firmly contact the lockarm and then tightening the lock pin thereby locking the adjustment cylinder in the desired position.

12. A portable gun holder as claimed in claim 8 wherein the clamping pads are attached to the clamping arms by means of a plurality of configuration adjustment rods where one end of each of said rods is attached to the back of the clamping pad, the remaining end passing through a corresponding number of apertures in the clamping arm, said clamping arm being equipped with a locking means for locking the adjustment rods in a fixed position.

13. A portable gun holder as claimed in claim 12 wherein the horizontal placement of the clamping pad may be altered by means of a clamping pad placement rod which fits within a recess in the back of the clamping pad; the other end of the placement rod passing through an aperture in the side wall of the pad, the placement rod being capable of being locked in place by means of a set screw which passes through a threaded aperture in the side wall of the clamping arm and may be tightened down to engage the configuration rod.

14. A portable gun holder as claimed in claim 8 wherein a portion of the floor of the carrying case rests within grooves in the front wall and rear floor section of the carrying case and may be pulled outward thereby lengthening the distance between the front-end support member and the rear-end support and clamping member.

* * * * *